US005535600A

United States Patent [19]

Mills

[11] Patent Number: 5,535,600

[45] Date of Patent: Jul. 16, 1996

[54] COOLING SYSTEM FOR A POST-MIX BEVERAGE DISPENSER

[75] Inventor: Jeffrey P. Mills, Georgetown, Mass.

[73] Assignee: Jet Spray Corp., Norwood, Mass.

[21] Appl. No.: 350,623

[22] Filed: Dec. 7, 1994

[51] Int. Cl.[6] ..... B67D 5/62

[52] U.S. Cl. ..... 62/390; 62/434; 62/435; 62/393

[58] Field of Search ..... 62/389, 395, 396, 62/393, 310, 435, 436, 434; 222/148, 146.1, 129.1, 146.6

[56] References Cited

U.S. PATENT DOCUMENTS

| | | | |
|---|---|---|---|
| Re. 33,943 | 6/1992 | Arzberger et al. . | |
| D. 109,919 | 5/1938 | McHenry . | |
| D. 193,759 | 10/1962 | Hodgman . | |
| D. 202,023 | 8/1965 | Gordon . | |
| 441,628 | 11/1890 | Coon et al. . | |
| 1,046,252 | 12/1912 | Berryman | 62/435 |
| 1,649,688 | 11/1927 | Harrison . | |
| 1,654,379 | 12/1927 | Matzka . | |
| 1,708,212 | 4/1929 | Benham . | |
| 1,760,887 | 6/1930 | Saugman . | |
| 1,782,943 | 11/1930 | Stanford et al. . | |
| 1,782,944 | 11/1930 | Stanford et al. . | |
| 1,799,852 | 4/1931 | Jones . | |
| 2,072,841 | 3/1937 | Tracey et al. . | |
| 2,186,564 | 1/1940 | Thiberg . | |
| 2,278,383 | 3/1942 | Rosenblatt . | |
| 2,741,400 | 4/1956 | Hazzard . | |
| 3,255,609 | 6/1966 | Jacobs et al. . | |
| 3,323,813 | 6/1967 | Gordon . | |
| 3,339,934 | 9/1967 | Gordon . | |
| 3,341,077 | 9/1967 | Gordon . | |
| 3,342,384 | 9/1967 | Jacobs . | |
| 3,360,956 | 1/1968 | Gordon . | |
| 3,385,413 | 5/1968 | Jacobs et al. . | |
| 3,503,541 | 3/1970 | Jacobs et al. . | |
| 3,539,081 | 11/1970 | Norton et al. . | |
| 3,568,887 | 3/1971 | Jacobs et al. . | |
| 3,575,536 | 4/1971 | Jacobs et al. . | |
| 3,582,096 | 6/1971 | Norton et al. . | |
| 3,591,055 | 7/1971 | Norton . | |
| 3,710,981 | 1/1973 | Arzberger et al. . | |
| 3,730,144 | 5/1973 | Arzberger . | |
| 3,730,488 | 5/1973 | Gardner, Jr. . | |
| 3,737,076 | 6/1973 | Gardner, Jr. et al. . | |
| 3,822,565 | 7/1974 | Arzberger . | |
| 3,851,127 | 11/1974 | Gardner, Jr. et al. . | |
| 3,880,329 | 4/1975 | Gardner, Jr. et al. . | |
| 3,915,341 | 10/1975 | Brown . | |
| 3,920,163 | 11/1975 | Brown . | |
| 3,927,802 | 12/1975 | Lavochkin et al. . | |
| 3,998,070 | 12/1976 | Muelier | 62/396 |
| 4,124,994 | 11/1978 | Cornelius et al. | 62/435 |
| 4,610,145 | 9/1986 | Arzberger et al. . | |
| 4,645,095 | 2/1987 | Coppola . | |
| 4,717,045 | 1/1988 | Coppola . | |
| 4,728,005 | 3/1988 | Jacobs et al. . | |
| 4,730,463 | 3/1988 | Stanfill | 62/396 |
| 5,402,914 | 4/1995 | Zapp . | |

FOREIGN PATENT DOCUMENTS

| | | |
|---|---|---|
| 1244907 | 11/1988 | Canada . |

*Primary Examiner*—John M. Sollecito
*Attorney, Agent, or Firm*—Wolf, Greenfield & Sacks

[57] ABSTRACT

A cooling system for post-mix beverage dispenser includes an ice bath tank for holding a liquid, a refrigeration circuit for cooling the liquid in the ice bath tank, a concentrate storage area, and a cooling circuit coupled to the ice bath tank, for cooling the concentrate storage area. A pump in the cooling circuit transfers the liquid from the ice bath tank to a coil in the concentrate storage container. The circuit returns the liquid to the ice bath tank and creates the turbulence necessary for the liquid to freeze evenly in the tank. Thus, an agitator assembly is not necessary. A fan in the concentrate storage area circulates air over the coil. The pump can be selectively coupled to drain the tank.

28 Claims, 3 Drawing Sheets

COOLING SYSTEM FOR A POST-MIX BEVERAGE DISPENSER

FIELD OF THE INVENTION

This invention relates to beverage dispensers.

BACKGROUND OF THE INVENTION

A post-mix beverage dispenser reconstitutes a syrup by mixing it with potable water in pre-settable proportions, and dispenses on demand a beverage, such as orange juice or fruit punch. Typical post-mix dispensers, such as that shown in Reissue U.S. Pat. No. 33,943, have at least one container which holds the syrup. The containers are kept in an enclosed concentrate storage area which is kept cool by a refrigerant-based refrigeration system. The potable water is chilled prior to being mixed by flowing through a potable water coil is submerged in an ice bath tank. Because the concentrate and potable water are cooled, the reconstituted beverage is cool and refreshing.

In the typical dispenser, the same vapor compression refrigeration cycle cools both the ice bath tank and the concentrate storage area. The ice bath tank is filled with bath water which is cooled by a refrigerant coil disposed in the tank. The tank is located in an upper portion of the dispenser behind the concentrate storage area. The refrigerant coil disposed in the ice bath tank is the evaporator component in the refrigeration cycle and ice forms in the tank around the refrigerant coil during the operation of the dispenser.

The concentrate storage area which surrounds the concentrate container is primarily cooled by convection. A fin tubular coil is disposed in the concentrate storage area and is connected in series with the refrigerant coil in the ice bath. Thus, when the refrigerant cycle is energized to supply refrigerant to cool the ice bath, it also cools the concentrate storage area. A fan continuously circulates air over the coil in the concentrate storage area to enhance the cooling effect of the coil. The concentrate storage area is also cooled by heat transfer at an uninsulated common wall between the ice bath and the concentrate storage area.

The ice bath water is constantly agitated by an agitator assembly that has an impeller connected to a shaft that extends downward into the ice bath tank. The shaft is coupled to a motor mounted above the ice bath tank. The motor operates continuously while the dispenser is energized. The impeller agitates the ice bath water at the center of the tank to create turbulence in the bath water.

The temperature in the concentrate storage area is largely dependent on the refrigeration cycle. When the refrigerant is not flowing through the fin-tubular coils, the temperature of the concentrate storage compartment rises to about 42° F. to 44° F. When refrigeration cycle is "on" an refrigerant flows through the coils, the temperature in the concentrate storage area is decreased. Immediately before the end of the on cycle, the compartment could be as low as 34° F. As a result, there is a fluctuation of up to about 10° F. in temperature in the concentrate storage area.

SUMMARY OF THE INVENTION

According to the present invention, a beverage dispenser has a concentrate cooling circuit which cools the concentrate storage area, and thus the concentrate, to a lower and more consistent temperature than in typical dispensers. A beverage dispenser of the present invention includes a compartment for holding a first container, a refrigerated second container for holding a liquid and a liquid conduit which is fluidly coupled to the second container and partially disposed within the compartment. A circulation pump is fluidly coupled to the liquid conduit and circulates the liquid from the second container to the liquid conduit in the compartment.

The refrigerated second container is preferably an ice bath tank that is cooled by a refrigerant in an evaporator coil. The compartment is preferably a concentrate storage area that is cooled by pumping chilled bath water from the ice bath tank through a chilled water conduit in the concentrate storage area and then back to the ice bath tank. The pump preferably runs continuously while the machine is energized. A fan blows air across the chilled water coil to cool air around the concentrate storage area and thus the concentrate liquid.

The water circulated to the liquid coil is returned to the ice bath tank through a conduit extending into the tank. With this arrangement, the force of the returning water agitates the water in the ice bath tank. Thus, an agitator impeller and motor assembly for creating turbulence in the tank is unnecessary. Because the water in the ice bath tank is consistently at about 0° C. (32° F.) and is always flowing through the chilled water coils, the concentrate storage area is kept at a consistent and cool temperature, basically 37° F. in a 70° F. ambient. The circulation pump which transfers the liquid from the ice bath tank to the chilled water coils can also be coupled to a valve which makes it easier to empty the tank for cleaning. Because the length of the refrigeration coil is reduced compared to typical dispensers, the dispenser of the present invention is safer to use and operate because the chances of a refrigerant leak is reduced.

The present invention improves on at least two of the performance measures of beverage dispensers, including the stability of the brix and the casual drink temperature. The brix is a measure of the sugar content of a drink. The brix is may be different for different types of drinks, e.g., it is preferably about 11.8 for orange juice, but may have a different value for apple juice or cranberry juice. The brix is a function of the sugar content in the particular syrup used to make the drink and of the ratio of syrup and water. This ratio varies with the temperature of the syrup in that a higher temperature syrup has less viscosity than a cooler syrup, and therefore more syrup is dispensed in the same period of time if it is warmer. To maintain a consistently flavored drink, the brix should be stable and have minimal variation. According to the present invention, since the syrup is kept at a more consistent temperature than in prior systems, i.e., about 37°±1° F., the brix has less variation than prior dispensers, typically within about 0.5 of a target value.

The casual drink temperature is the measured temperature of the drink after the dispenser has been unused for an extended period of time in a 70° ambient environment. The temperature of a drink is higher because of both the water and syrup. The water in the potable water conduit between the valve and the ice bath is warmer than the water in the conduit in the ice bath. In prior systems in which the syrup is cooled by the same system that cools the ice bath, the syrup gets relatively warm after being unused, e.g., about 45° since the cooling system is not heavily used to cool the ice bath. Typical values for the casual drink temperature are about 45° F., with some devices being higher. According to the present invention, however, the casual drink temperature can be about 41° F. or even lower.

BRIEF DESCRIPTION OF THE DRAWINGS

Other features and advantages will become apparent from the following detailed description and from the drawings in which.

DETAILED DESCRIPTION

Figure 1:
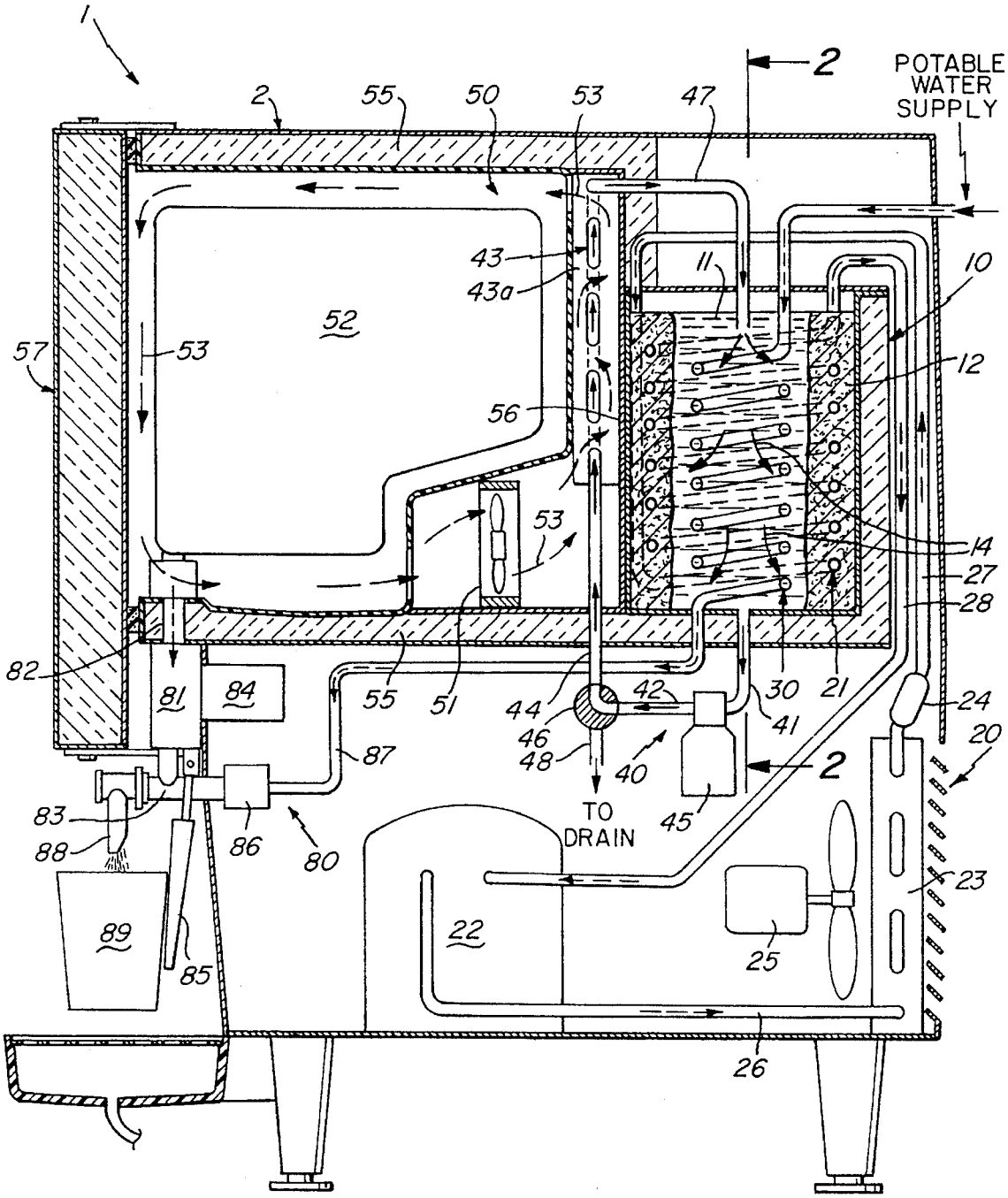
FIG. 1 is a partial schematic, partial cross-sectional side elevational view of a post-mix beverage dispenser according to the present invention.

Referring to FIG. 1, a post-mix beverage dispenser 1 has a housing 2 that encloses an ice bath tank 10 for cooling a potable water coil 30, a refrigeration system 20 which cools the ice bath tank, a concentrate storage area 50 for holding a storage tank 52 with a syrup, and a chilled water cooling circuit 40 which cools the storage area 50.

To obtain a drink from the dispenser, a user depresses a push handle 85 with a cup 89, thus causing a dispenser assembly, indicated generally by 80, to mix potable water and syrup in a mixing block 83 and to dispense the juice through a spout 88. The beverage dispenser assembly receives potable water through a potable water coil 30 connected to a conduit 87. Potable water is supplied to the mixing block by depressing the push handle which activates a solenoid valve 86 coupled to conduit 87. The dispenser assembly is fluidly connected to syrup tank 52 by a conduit 82. A concentrate pump 81 pumps syrup through a conduit 82 to the mixing block. Pump 81 is operated by a motor 84 that is activated when push handle 85 is depressed. Accordingly, depressing the push handle activates both solenoid valve 86 and concentrate pump motor 84 to cause potable water and syrup to flow into mixing block 83 in predetermined amounts. The two liquids are mixed in the mixing block and are dispensed through the discharge spout into the cup.

Figure 2:
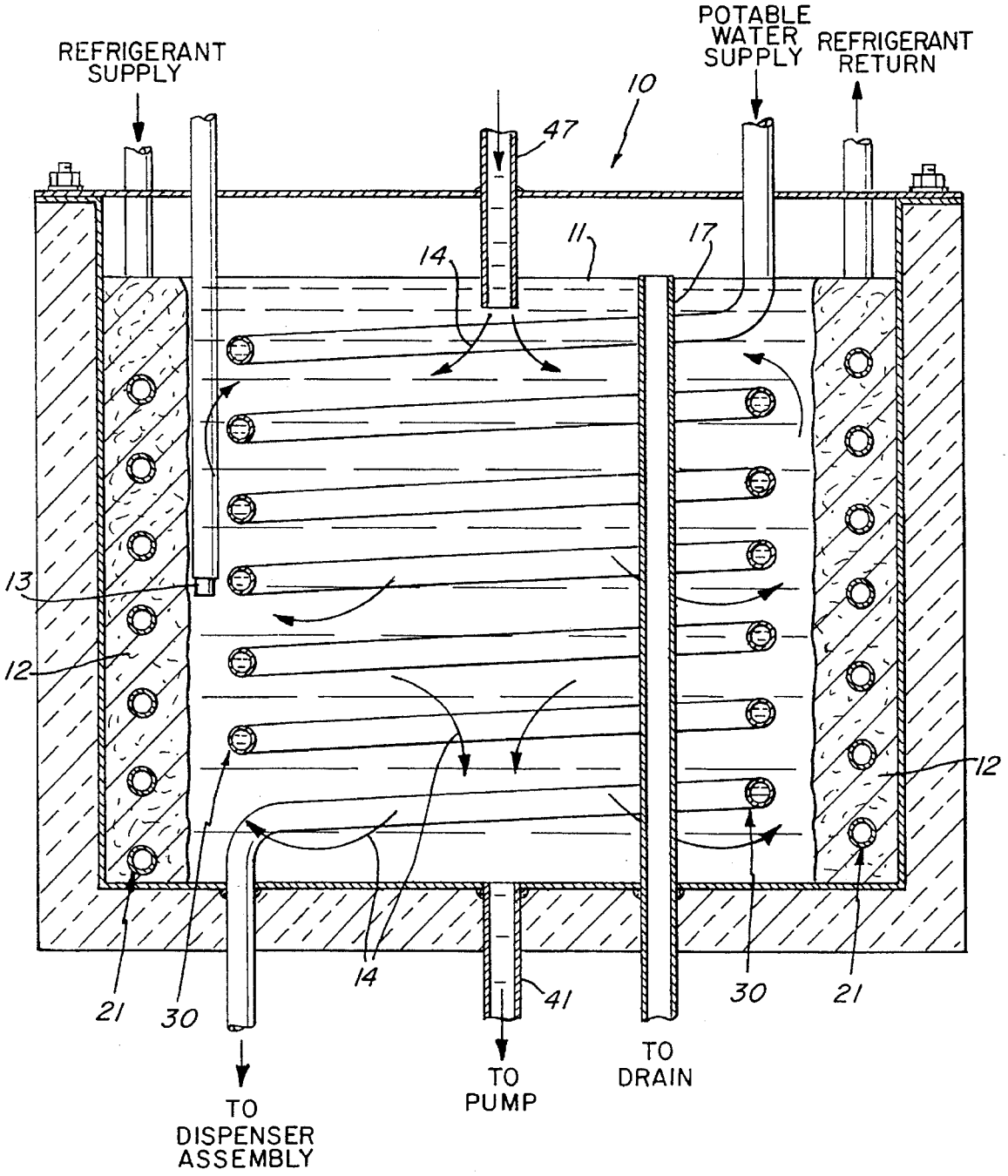
FIG. 2 is a cross-sectional view taken along section lines 2—2 of FIG. 1.

Referring to FIGS. 1 and 2, ice bath tank 10 is filled with bath water 11 that is cooled by a helically wound copper refrigeration coil 21 disposed around the inner perimeter of tank 10. Refrigeration coil 21 chills water 11 enough so that ice 12 forms around coil 21. The temperature of the water in the tank is therefore consistently about 0° C. (32° F.). Ice 12 extends inward from the inner walls of the tank.

Potable water coil 30 receives water from a remote water supply, such as a municipal water system, and is submerged in the ice bath tank 10. The potable water that flows through coil 30 is thus chilled by the bath water. When the dispenser is in extended use, the ice that is formed in tank 10 provides a reserve cooling capacity by absorbing the heat removed from the potable water.

An overflow conduit 17 (FIG. 2) extends vertically from the bottom of tank 10 to a desired fill level to prevent the tank from overflowing. The bottom of conduit 17 is connected to a drain (not shown). If water 11 reaches the top of conduit 17, it spills into conduit 17 and is drained.

A sensor 13 (FIG. 2) is provided within the tank 10 to energize and deenergize the refrigeration system. When the ice on the refrigeration coil extends to a certain predetermined limit, sensor 13 detects a change in electrical conductivity of the water. The sensor thus controls the ice formation by deenergizing the refrigeration system 20 when the ice reaches a predetermined limit so that the bath water does not completely freeze. It is important that the ice bath not completely freeze because the potable water in the potable water coil must not freeze.

Referring to FIG. 1, refrigeration system 20 includes a compressor 22, a condenser coil 23, a filter dryer 24, and the refrigeration (evaporator) coil 21. The system compresses refrigerant in the compressor 22. The refrigerant is transferred from the compressor to the condenser coil 23 through a conduit 26. A fan 25 blows air over the condenser coil 23 to condense the refrigerant. Once the refrigerant has been condensed from a gas to a liquid, the liquid moves through a conduit 27 to the refrigeration coil 21. The filter dryer is disposed in the conduit 27 to control the fluid in the conduit. As the refrigerant evaporates, coil 21 absorbs the heat surrounding the coil, thus cooling the bath water surrounding the coil sufficiently so that it freezes. Once the refrigerant evaporates in the refrigeration coil, it moves through a conduit 28 to the compressor and then to the condenser. The cooling cycle continues until sensor 13 (FIG. 2) deenergizes the refrigeration system.

Adjacent the ice bath tank, the housing also encloses the concentrate storage area, which is insulated by insulation 55 on all sides of the storage area 50, except for a wall 56 between the ice bath tank and the storage area. The storage area 50 is accessible to users through an insulated hinged door 57.

Figure 3:
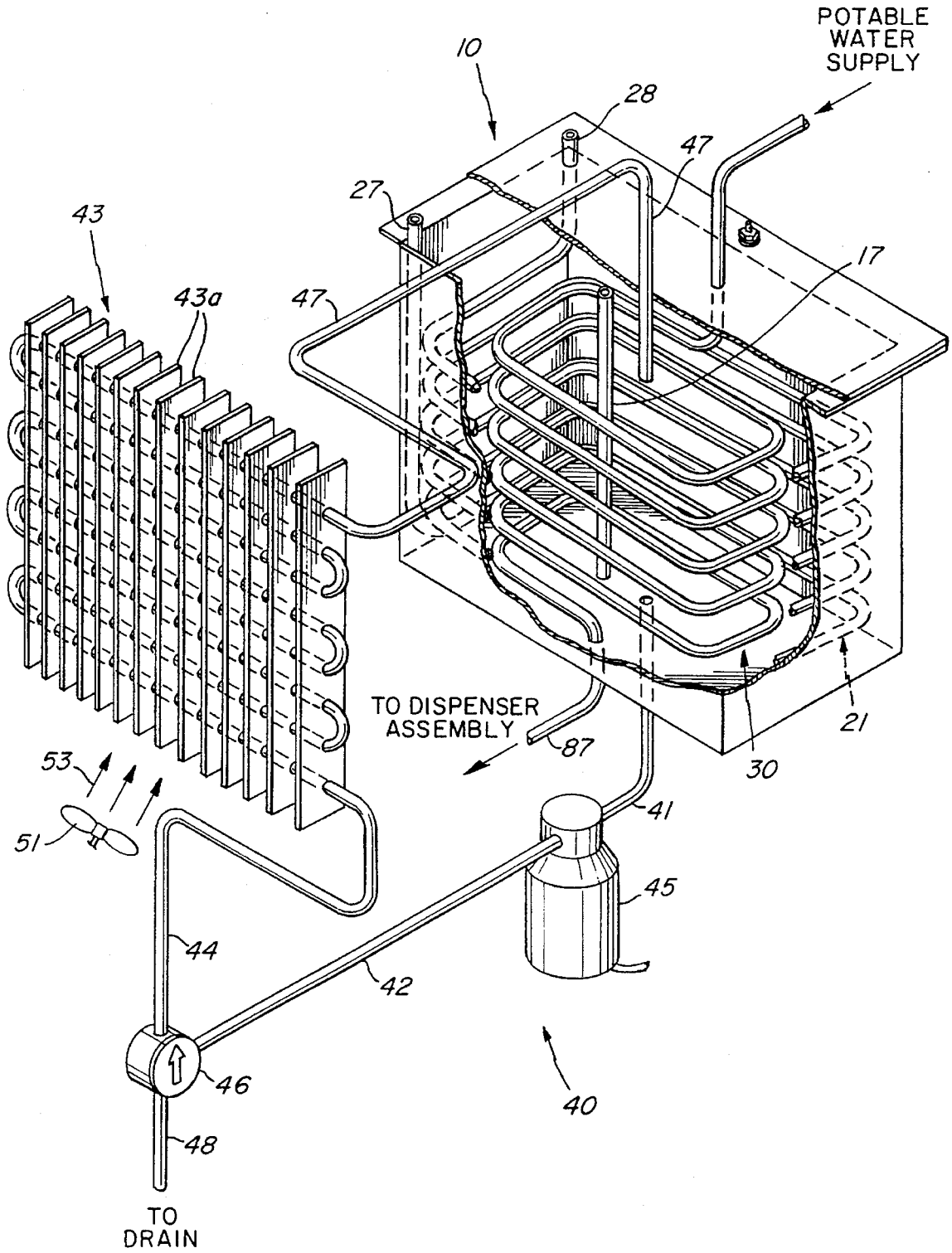
FIG. 3 is a schematic perspective view of certain components of the present invention.

As shown in FIGS. 1 and 3, a cooling circuit 40, cools the concentrate storage area and in turn the syrup, and maintains the syrup at a desired temperature with a chilled water coil 43. Coil 43 and ice bath tank 10 are fluidly coupled by fluid conduits 41, 42, and 44, which transfer the chilled water with a pump 45 from ice bath tank 10 to coil 43. The terms "fluidly coupled" and "fluidly connected" are used here to refer to any connection which enables fluid to flow between connected elements. Coil 43 has a serpentine shape and is provided with elongated fins **43*a* which enhance the transfer of heat between the concentrate storage area and coil 43. A fan 51 is provided in the concentrate storage area below the container. The fan circulates air (shown by arrows 53) around the chilled water coil to enhance the heat transfer between coil 43 and concentrate storage area 50. The fan is has a thermostat (not shown) which shuts the fan off if the temperature of the area 50 drops below 35° F. A return conduit 47 transfers return water from the chilled water coil to the ice bath tank. The conduits 41, 42, 44, 47 and water coil 43** thus form a chilled water fluid circuit.

The circulation pump for circulating the chilled water from the ice bath tank to the chilled water coil and back again is coupled to conduits 41 and 42. The pump can be disposed at different locations in the chilled water fluid circuit. The pump, preferably a model G-100 A5, available from Beckett Corp., Dallas, Tex., constantly circulates water while the dispenser is energized.

The concentrate storage area is maintained at a cool temperature because the ice bath water, which is always substantially about 32° F., constantly flows through water coil 43 while the dispenser is energized. Because of this constant flow, the temperature of concentrate storage area 50 is maintained substantially constant. In the typical prior dispensers, by contrast, the temperature of concentrate storage area 50 fluctuated because refrigerant chilled the storage area only when the ice bath tank sensor energized the refrigerant cycle to produce more ice in the ice bath tank. Consequently, according to the present invention, water coil 45 keeps the concentrate storage area cooler and thus, the concentrate is kept cooler and fresher for a longer period of time. Furthermore, the cooler and consistent temperature helps keep the brix more constant than in prior systems because there is less variation in viscosity, thus causing the brix to be within a range preferably of about 0.5; and also helps to keep a low casual drink temperature, preferably about 41° F. or less.

The return conduit extends downward into the tank and has an outlet centrally disposed in the tank. The returning water flowing from return conduit 47 into the ice bath tank agitates the water (as indicated by arrows 14) so that the ice on the refrigeration coil builds up evenly and thus enhances the heat transfer between the bath water and the potable water in the potable water coil. Because the returning water creates the turbulence in the ice bath tank sufficient to provide for an even build-up of ice, an agitator assembly, as provided in typical prior dispensers, is not needed.

Referring to FIG. 3, the circulation pump can also be used to conveniently pump bath water out of the ice bath tank when the tank is emptied periodically for cleaning or for maintenance. A valve 46 is provided between conduits 42 and 44 at the downstream side of the pump. Valve 46 has a first position (as shown) in which pump 45 is fluidly coupled to water coil 43. To empty ice bath tank 10, valve 46 is switched to a second position in which pump 45 transfers the ice bath water to a conduit 48 that leads to a drain (not shown). Valve 46 can be disposed at any location along the fluid circuit, although it should be at the discharge side of the pump. If the valve and pump are coupled to conduit 47, the pump is useful for pumping water from water coil 43.

Having described and illustrated this invention in detail, those skilled in the art upon reading the description will recognize that numerous modifications may be made without departing from the spirit of the invention. Therefore it is not intended that the scope of the invention be limited to the specific embodiment described. For example, certain coils can be constructed in different shapes including a "figure 8" shape or a serpentine shape. The conduit described could be formed from more than one piece and be constructed of different materials fluidly coupled together. The beverage dispensing can be activated by one or more control buttons which are depressed, rather than a pivot switch. The sensor could also be a capillary sensor that is in the ice and detects the presence of water.

What is claimed is:

1. A post-mix beverage dispenser:

a housing;

a tank disposed in the housing for containing a liquid, said tank having a bottom;

a refrigerated conduit extending into the tank for circulating a refrigerant to cool said liquid;

a compartment disposed in the housing for holding a container of syrup;

a chilled liquid coil disposed in the compartment;

a first liquid conduit extending from the bottom of the tank that fluidly connects the tank to the chilled liquid coil;

a second fluid conduit leading from the chilled liquid coil to the tank, wherein the second fluid conduit is positioned in a predetermined location in the tank to agitate the liquid in the tank, the first and second fluid conduits and the chilled liquid coil forming a fluid circuit;

a circulation pump disposed within the fluid circuit for circulating the liquid from the tank to the chilled liquid coil;

a potable water conduit for receiving potable water, the potable water conduit disposed in the tank, wherein the liquid in the tank chills the potable water in the potable water coil;

a syrup conduit fluidly connected to the container; and a dispenser assembly, fluidly connected to the potable water conduit and the syrup conduit, for mixing a predetermined amount of potable water with a predetermined amount of syrup to form the beverage.

2. The beverage dispenser of claim 1, wherein the refrigerated conduit extends into the tank and is constructed so that the liquid freezes around the refrigeration coils during operation.

3. The beverage dispenser of claim 1, wherein the second liquid conduit delivers liquid to the tank so that the liquid in the tank is agitated.

4. The beverage dispenser of claim 1, further comprising:

a valve disposed in the fluid circuit; and a drain conduit, wherein the valve has a first position in which the pump is fluidly connected to the chilled liquid core, and a second position in which an outlet of the pump is fluidly coupled to the drain conduit, the valve being selectively actuable for circulating and draining the liquid.

5. The beverage dispenser of claim 2, further comprising fins disposed on the chilled liquid coil for enhancing the transfer of heat between the chilled liquid coil and the compartment.

6. The beverage dispenser of claim 5, further comprising a fan disposed in the chamber for circulating air over the chilled liquid coil fins.

7. The beverage dispenser of claim 1, wherein the fluid circuit maintains the syrup at about 37° F. when the beverage dispenser operates in an ambient temperature of about room temperature.

8. A beverage dispenser having a compartment for holding a first container, the beverage dispenser comprising:

a refrigerated second container for holding a liquid having a bottom, a liquid conduit fluidly coupled to the second container and at least partially disposed within the compartment said liquid conduit extending from the bottom of the second container; and a circulation pump fluidly coupled to the liquid conduit for circulating the liquid from the second container through the liquid conduit.

9. The beverage dispenser of claim 8, further comprising a refrigeration coil disposed in the second container, and means for cooling the refrigeration coil sufficiently so the liquid freezes around the refrigeration coil.

10. The beverage dispenser of claim 8, wherein the beverage dispenser is a post-mix beverage dispenser and includes:

a potable water conduit disposed in the second container for chilling potable water, a dispenser assembly fluidly connected to the potable water conduit, and a first container conduit fluidly connecting the first container and the dispenser assembly, the first container for holding a syrup, wherein, when the dispenser assembly is activated, a predetermined amount of potable water is mixed in the dispenser assembly with a predetermined amount of syrup from the first container to form a beverage.

11. The beverage dispenser of claim 8, wherein the liquid conduit extends into the second container so that the liquid in the second container is agitated when liquid flows from the fluid conduit.

12. The beverage dispenser of claim 8, wherein the liquid conduit extends downward into the second container at a generally central location.

13. The beverage dispenser of claim 8, further comprising:

a valve disposed in the fluid circuit; and a drain conduit, wherein the valve has a first position in which the pump is fluidly connected to the liquid conduit, and a second position in which an outlet of the pump is fluidly coupled to the drain conduit, the valve being selectively actuable for circulating and draining the liquid.

14. The beverage dispenser of claim 8, wherein a cooling coil is disposed in the compartment to enhance the heat transfer between the liquid conduit and the compartment and the liquid conduit is fluidly connected to the cooling coil.

15. The beverage dispenser of claim 14, wherein a fan is disposed in the compartment to circulate air over the chilled liquid coil.

16. The beverage dispenser of claim 8, wherein the first container is maintained at a constant temperature of about 37° F. when the beverage dispenser operates in an ambient temperature of about room temperature.

17. The beverage dispenser having a housing forming a compartment for receiving a beverage container a refrigerated tank disposed in the housing having a bottom surface, said refrigerated tank containing a liquid the temperature of which is controlled to provide a cooled liquid, a fluid circuit communicating with said refrigerated tank said circuit extending from the bottom of the tank, and including a chilling member disposed in said compartment for the cooling thereof, and a circulation pump fluidly coupled in the fluid circuit for circulating the cooled liquid between the refrigerated tank and the chilling member.

18. The beverage dispenser of claim 17, further comprising a refrigeration coil disposed in the refrigerated tank, and means for cooling the refrigeration coil sufficiently so the liquid freezes around the refrigeration coil.

19. The beverage dispenser of claim 17, wherein the beverage dispenser is a post-mix beverage dispenser and includes:

a potable water conduit disposed in the refrigerated tank for chilling potable water, a dispenser assembly fluidly connected to the potable water conduit, and wherein when the dispenser assembly is activated, a predetermined amount of potable water is mixed in the dispenser assembly with a predetermined amount of beverage from the beverage container to form a dispensed beverage.

20. The beverage dispenser of claim 17, wherein the fluid circuit extends into the liquid in the refrigerated tank in a manner so that the liquid is agitated when the liquid flows in the fluid circuit.

21. The beverage dispenser of claim 17, wherein the fluid circuit includes opposite ends that are disposed at the respective top and bottom of the refrigerated tank.

22. The beverage dispenser of claim 17 further comprising a valve disposed in the fluid circuit, and a drain conduit, wherein the valve has a first position in which the pump is fluidly connected to the fluid circuit, and a second position in which an outlet of the pump is fluidly coupled to the drain conduit, the valve being selectively actuable for circulating and draining the liquid.

23. The beverage dispenser of claim 17, wherein the chilling member includes a cooling coil disposed in the compartment to provide cooling of the compartment.

24. The beverage dispenser of claim 23 wherein a fan is disposed in the compartment to circulate air over the cooling coil.

25. The beverage dispenser of claim 17 including a compressor, a condenser and a filter dryer, all fluidly interconnected with a refrigeration coil in the refrigerated tank.

26. The beverage dispenser according to claim 1, wherein the conduit extends from a central position in the bottom of the tank.

27. The beverage dispenser according to claim 8, wherein the conduit extends from a central location of the bottom of the second container.

28. The beverage dispenser according to claim 22, wherein the circuit extends from a central location in the bottom surface of the refrigerated container.

* * * * *